United States Patent [19]

Taguchi

[11] Patent Number: 4,701,955

[45] Date of Patent: Oct. 20, 1987

[54] VARIABLE FRAME LENGTH VOCODER

[75] Inventor: Tetsu Taguchi, Tokyo, Japan

[73] Assignee: NEC Corporation, Tokyo, Japan

[21] Appl. No.: 544,198

[22] Filed: Oct. 21, 1983

[30] Foreign Application Priority Data

Oct. 21, 1982 [JP] Japan ..... 57-185196
Jul. 19, 1983 [JP] Japan ..... 58-131439

[51] Int. Cl.[4] ..... G10L 1/00
[52] U.S. Cl. ..... 381/51
[58] Field of Search ..... 381/29-40, 381/41-45, 49-51, 53

[56] References Cited

U.S. PATENT DOCUMENTS

| | | | |
|---|---|---|---|
| 3,816,722 | 6/1974 | Sakoe et al. | 364/728 |
| 4,100,370 | 7/1978 | Suzuki et al. | 381/42 |
| 4,189,779 | 2/1980 | Brantingham | 364/718 |
| 4,393,272 | 7/1983 | Itakura et al. | 381/51 |

OTHER PUBLICATIONS

Reddy, Raj and Robert Watkins "Use of Segmentation and Labeling in Analysis-Synthesis of Speech", International Conference on Acoustics Speech and Signal Processing (ICASSP), 1977, pp. 28 to 32.

Cole, E. Randolph and Thomas Boynton, "A Real--Time Floating Paint Variable Frame Rate LPC Vocoder", International Conference on Acoustics Speech and Signal Processing (ICASSP), 1977, pp. 429, 432.

Blackman, E. et al., "Variable-to-Fixed Rate Conversion of Narrowband LPC Speech", International Conference on Acoustics Speech and Signal Processing (ICASSP) 1977, pp. 409-412.

Fushikida, K., "A Variable Frame Rate Speech Analysis-Synthesis Method Using Optimum Square Wave Approximation" Acoustics Institute of Japan, May 1978, pp. 385 to 386.

Itakur et al., "A Hardware Implementation of a New Narrow to Medium Bank Speech Coding", International Conference on Acoustics Speech & Signal Processing (ICASSP), 1982, pp. 1964-1967.

Dudley, "Phonetic & Pattern Recognition Vocoder for Narrow Band Speech Transmission" the Journal of the Acoustic Society of America, vol. 30, No. 8, Aug. 1958, pp. 733-739.

Fushikida and Oshiai Acoustic Inst. 574-23 (1974), "Variable Frame Period Type Voice Analisis & Synthesis System by using Optimum Rectangular Waveform Approximation".

*Primary Examiner*—Gareth D. Shaw
*Assistant Examiner*—John G. Mills
*Attorney, Agent, or Firm*—Sughrue, Mion, Zinn, Macpeak, and Seas

[57] ABSTRACT

A variable frame length vocoder extracts a feature vector for each given frame, a predetermined number of frames being defined as a section. The feature vectors in each section are stored, changes in feature vectors within a section being approximated by a given number of variable time length flat sections with a constant time length portion between adjacent flat sections, adjacent flat sections being interconnected by an inclined section of the constant time length duration. A feature vector of each flat section is outputted as a representative vector of the flat section, and the number of frames comprising the flat section is outputted as a repeat signal. This information is processed at the synthesis side of the vocoder to produce the feature vector in each inclined section by interpolating the representative vectors of the flat sections on both sides of the inclined section.

11 Claims, 8 Drawing Figures

VARIABLE FRAME LENGTH VOCODER

BACKGROUND OF THE INVENTION

This invention relates to a variable frame length vocoder, and more particularly to improvements in a dynamic characteristic of the synthesis filter and the compression of the data rate.

A vocoder using the so-called LSP (Line Spectrum Pair) as speech spectrum information has the advantage that high quality synthesized speech is obtainable with a low data rate. The principle and examples of the application of the principle are given in detail in the paper by Fumitada Itakura et al. entitled "A HARDWARE IMPLEMENTATION OF A NEW NARROW TO MEDIUM BAND SPEECH CODING", International Conference on Acoustics Speech and Signal Processing (ICASSP), 1982, pp. 1964 to 1967.

The parameter value such as the LSP parameter indicating the spectrum information of the speech changes at a relatively gentle rate although sometimes abruptly. For example, while the parameter abruptly changes at a transition part of a vowel or consonant, the change at a voiced sound part is extremely gentle. Consequently, by changing frame length in accordance with the time change characteristic of the parameters, further information compression will be attainable as compared with a vocoder with the frame length fixed. The vocoder according to such system is called a variable frame length vocoder, which is proposed in the paper by John M. Turner and Bradley W. Dickinson entitled "A VARIABLE FRAME LENGTH LINEAR PREDICTIVE CODER", International Conference on Acoustics Speech and Signal Procesing (ICASSP), 1978, pp. 454 to 457, and the report by Katsunobu Fushikida: "A VARIABLE FRAME RATE SPEECH ANALYSIS-SYNTHESIS METHOD USING OPTIMUM SQUARE WAVE APPROXIMATION", Acoustics Institute of Japan, May 1978, p. 385 to 386.

The variable frame length vocoder proposed in the former report uses a long frame interval for a portion with gentle change and a short frame interval for a portion with abrupt change in the characteristic of a spectrum power envelope. The latter report describes a technique using an optimum rectangular approximation based on dynamic programming (DP) and is based on the vocoder proposed in the former report. In this technique a predetermined number of frames are classified into a plurality of groups to minimize an error according to an optimum rectangular approximation, and thus a representative frame is obtained. However, the parameter between adjacent representative frames exhibits an abrupt change change in the above systems, which may cause the following problems.

In the variable frame length vocoder, a spectrum information parameter obtained through analysis is applied to the synthesis filter as a filter coefficient to change the transfer function of the synthesis filter each frame period. The quality of the speech synthesized by the synthesis filter is not determined only by the instantaneous value of the transfer function of the synthesis filter, or static characteristic, but depends largely on a change in the transfer function, or dynamic characteristic. When the transfer function changes abruptly and thus the change is nearly stepwise, the so-called "echo sound" is generated which degrades the quality of the synthesized speech. To suppress the echo sound, the representative frame section obtained on the analysis side is conventionally subjected to a linear interpolation to smooth a time change of the parameter, thereby improving the dynamic characteristic of the synthesis filter.

According to this method, however, the spectral characteristic of the synthesized speech does not coincide precisely with that of an input speech signal, thus generating an unnatural synthesized speech.

Then, in the above-mentioned LSP vocoder, there is an LSP type pattern matching vocoder available for carrying out a further information compression. A conception of such a pattern matching vocoder is disclosed, for example, in the report by HOMER DUDLEY entitled "Phonetic Pattern Recognition Vocoder for Narrow-Band Speech Transmission", THE JOURNAL OF THE ACOUSTICAL SOCIETY OF AMERICA, Vol. 30, No. 8, August 1958, pp. 733 to 739, or the report by Raj Reddy and Robert Watkins: "USE OF SEGMENTATION AND LABELING IN ANALYSIS-SYNTHESIS OF SPEECH", International Conference on Acoustics Speech and Signal Processing (ICASSP), 1977, pp. 28 to 32.

The LSP type pattern matching vocoder comprises selecting the most similar reference pattern to an input pattern among predetermined reference patterns by collating (matching) LSP coefficients analyzed on an LSP analyzer with those of the reference pattern, transmitting it to the synthesis side together with the sound source information. This method has recently become well known as a method capable of further information compression, and can be easily constituted by adding a pattern matching function and a decoding function to an LPC vocoder.

A parameter space distance is employed as a pattern matching measure in the LSP type pattern matching vocoder. LSP coefficient can be regarded as a space vector as in the case of LPC, PARCOR coefficients, and the reference pattern most approximate to LSP coefficient of an input speech signal is selected by estimating the distances. The distance between LSP information which is a space vector is indicated by a spectral distance $E_{i,j}$ given in the following expression:

$$E_{i,j} = \frac{1}{\pi} \int_0^{\pi} \{S_i(\omega) - S_j(\omega)\}^2 d\omega \tag{1}$$

where $S_i(\omega)$ and $S_j(\omega)$ indicate logarithmic vectors of frames i and j which are functions of a frequency.

In order to select the reference pattern most approximate to a spectral envelope of the input speech signal among a reference pattern group registered beforehand, a calculation of spectral distance according to the expression (1) must be carried out for all frames. However, the arithmetic operation may run really vast in volume. Therefore, the spectral distance $E_{i,j}$ given by the following expression (2) is generally used as a matching measure.

$$E_{i,j} = \sum_{k=1}^{S} W_k \{P_k^{(i)} - P_k^{(j)}\}^2 \tag{2}$$

where $P_k^{(i)}$ and $P_k^{(j)}$ indicate LSP coefficient vectors having S dimensions in frame i and j, respectively, and $W_k$ indicates a weighting coefficient proportional to the LSP spectral sensitivity which is determined according to each LSP coefficient $P_k$.

A degree of the LSP coefficient corresponds to the degree of a all-pole digital filter for constituting a vocal carrier filter to be realized by the LSP coefficient. In the all-pole digital filter of S degree, S pieces of line spectra $\omega_1, \omega_2, \omega_3, \ldots \omega_k \ldots \omega_s$ called LSP frequency are used. The LSP spectral sensitivity $W_k$ indicates a degree of spectral change caused by an infinitesimal change of the LSP coefficient of S degree, for which LSP frequency spectral sensitivity determined in response to LSP frequency is normally used.

A distance calculation according to the expression (2) is carried out by obtaining the sum of the square of the difference between LSP coefficient $P_k^{(i)}$ of K-th frame which is a space feature vector of the analyzed input speech signal and a space feature vector $P_k^{(j)}$ registered as the reference pattern at every LSP coefficients of each degree, and then multiplying the squared difference by $W_k$ which is predetermined at every one of the LSP frequencies corresponding to the degree of LSP coefficient.

As described above, in the conventional distance calculation according to the expression (2), an LSP frequency spectral sensitivity determined by the LSP frequency is utilized as the weighting coefficient $W_k$. However, it has been confirmed that the LSP frequency spectral sensitivity also depends on LSP frequency interval. Therefore, the spectral distance calculation carried out simply according to the expression (2) is not satisfactory as a matching measure and deteriorates the quality of the synthesized voice.

SUMMARY OF THE INVENTION

An object of this invention is, therefore, to provide a variable frame length vocoder capable of providing a synthesized speech which sounds more natural.

Another object of this invention is to provide a vocoder in which information can be further compressed.

In accordance with the present invention, a variable frame length vocoder comprises, on an analysis side, means for obtaining a feature vector from an input speech signal at every given time length (frame) and storing the feature vectors in a given section having a predetermined number of frames, and is characterized in that a change in the feature vectors in the given section is approximated with a given number of flat sections indicating the period of time with little or no change in the feature vectors and inclined sections indicating periods with abrupt or sudden changes or transitions in feature vectors, the inclined sections connecting the neighboring flat sections with inclined lines, said flat section length being variable, said inclined section length being constant, the inclined line representing the change of feature vectors, the feature vector of given frames in each flat section being outputted as a representative vector of the flat sections, and the number of frames present in the flat section being outputted as a repeat signal on a synthesis side, and means for producing the feature in each of said inclined setions through interpolation between the representative vectors of the flat sections on both sides of said inclined section.

The other objects and features of the present invention will become more apparent from the following description when taken in conjunction with the accompanying drawings.

DETAILED DESCRIPTION OF THE PREFERRED EMBODIMENTS

The characteristic of the speech waveform over time varies with each speaker and also varies as a speaker speaks. These changes are caused chiefly by a change in the length of time a steady part of a speech sound is uttered. The time duration of a consonant portion and the transition portion between a consonant and a vowel is comparatively stable. A portion whereat a feature of the speech quickly changes is considered to be, in most cases, the transition portion, and its length is comparatively constant as mentioned above. Then, a change of transfer function is abrupt and correlates with a dynamic characteristic of the LSp synthesis filter, and a portion which is problematical from having no interpolation carried out therefor comes in the transition portion, in the majority of cases.

In the present invention, a predetermined section, for example, 200 mSEC of an input speech signal is divided into a plurality of inclined sections and a plurality of non-inclined (i.e., flat) sections at the analysis side. The time length of the transition portion between a consonant and a vowel is assumed to be constant for the inclined sections, and the inclined section length and the assumed time length are made to correspond with each other. On the other hand, for the non-inclined sections, the section length is made variable so as to correspond to a characteristic of the steady portion of unstable speech. In the invention, the predetermined section is subjected to an optimum trapezoidal approximation including the inclined sections and the non-inclined sections on the analysis side, and a trapezoidal interpolation of the LSP synthesis filter coefficient or the LSP parameter vector, which must correspond to the trapezoidal approximation is carried out on the synthesis side.

This invention has the effect that an approximation characteristic complying fully with an actual speech spectral change characteristic is obtained by the optimum trapezoidal approximation at the analysis side, and a more natural synthesized voice is obtainable at the synthesis side because the spectrum of the synthesized speech coincides well with that of the analyzed speech due to the interpolation of the LSP synthesis filter coefficient according to the above-mentioned approximation. In addition a transfer function of the LSP synthesis filter changes comparatively slow due to a linear approximation of the inclined section at the synthesis side, with the result that the so-called "echo sound" may be suppressed.

Figure 1A:
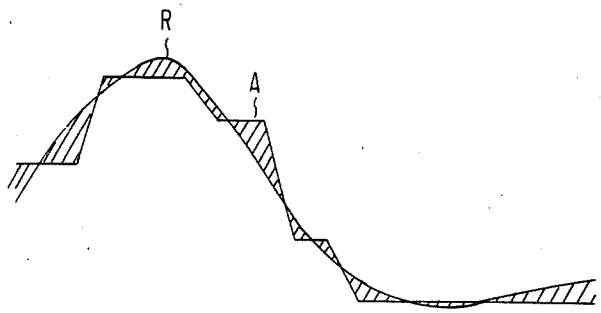
FIG. 1A and FIG. 1B illustrate the principle of the present invention.

A segmental optimum trapezoidal approximation according to the invention will be described, next. FIG. 1A is a waveform drawing for describing a conception of the segmental optimum trapezoidal approximation. In the drawing, a curve R represents an actual change of LSP parameter vectors, and a trapezoidal stepping segment group A is that for which the curve R is subjected to optimum trapezoidal approximation. An oblique line zone, as illustrated, surrounded by the curve R and the trapezoidal stepping segment group A is a distortion of the spectrum which arises as the result of trapezoidal approximation. The optimum trapezoidal approximation is to obtain the trapezoidal stepping segment group minimizing the area of the above-mentioned zone.

Figure 1B:
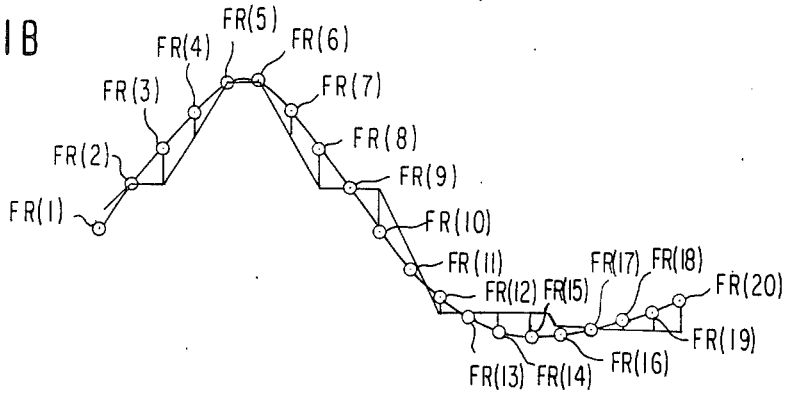

FIG. 1B is a waveform drawing for describing an actual segmental optimum trapezoidal approximation process. In the drawing, FR(1) to FR(20) denote LSP parameter vectors for 20 frames analyzed at every 10 mSEC for example. The segmental optimum trapezoidal approximation process is that for obtaining five frames and sections each represented by each of the five frames approximating the 20 frames most accurately through the trapezoidal approximation (consisting of an inclined section and a flat section). An inclined section length of the trapezoid is specified at a constant value 20 mSEC, for example, and a non-inclined section length of the trapezoid is specified as variable.

In execution of the trapezoidal approximation, the total sum of the distortions in the direction of the time axis for the non-inclined section and for the inclined section is taken as an appreciated value based on the result of selecting the trapezoidal stepping segment group. The latter distortion arises as the result of the LSP parameter vector of the frames included in the inclined section being substituted for by the LSP parameter vector obtainable through linear interpolation of two sets of the representative frames adjacent to the inclined section. For all representative frame candidacies, section candidacies represented by the representative frame candidacies, and inclined sections between the adjacent two section candidacies, the total sum of distortions in the time direction is obtained, and a combination whereby the total sum is minimize is selected as an optimum combination.

In the drawing, the representative frames are five frames FR(2), FR(5), FR(9), FR(13), FR(18), the frame sections represented by each representative frames are FR(2), FR(3), FR(5), FR(6), FR(8) to FR(10), FR(12) to FR(14), FR(16) to FR(20), the frames included in the inclined section are FR(1), FR(4), FR(7), FR(11), FR(15).

A total sum of the distortion G between the measured parameter curve R in the frames thus obtained and the approximate parameter line A is expressed by the following expression:

$$G = E_1 + E_{2,3} + E_4 + E_{5,6} + E_7 + E_{8,9} + E_{9,10} + E_{11} + E_{12,13} + E_{13,14} + E_{15} + E_{16,18} + E_{17,18} + E_{18,19} + E_{18,20} \quad (3)$$

where Ei,j is a distance between the parameters at frames FR(i) and FR(j) defined by expression (2), and $E_k$ is a distance between the actual parameter at frame FR(K) and the interpolated parameter obtained by interpolating on the basis of the parameters at the selected frames preceding and subsequent to the frame FR(K).

Figure 2:
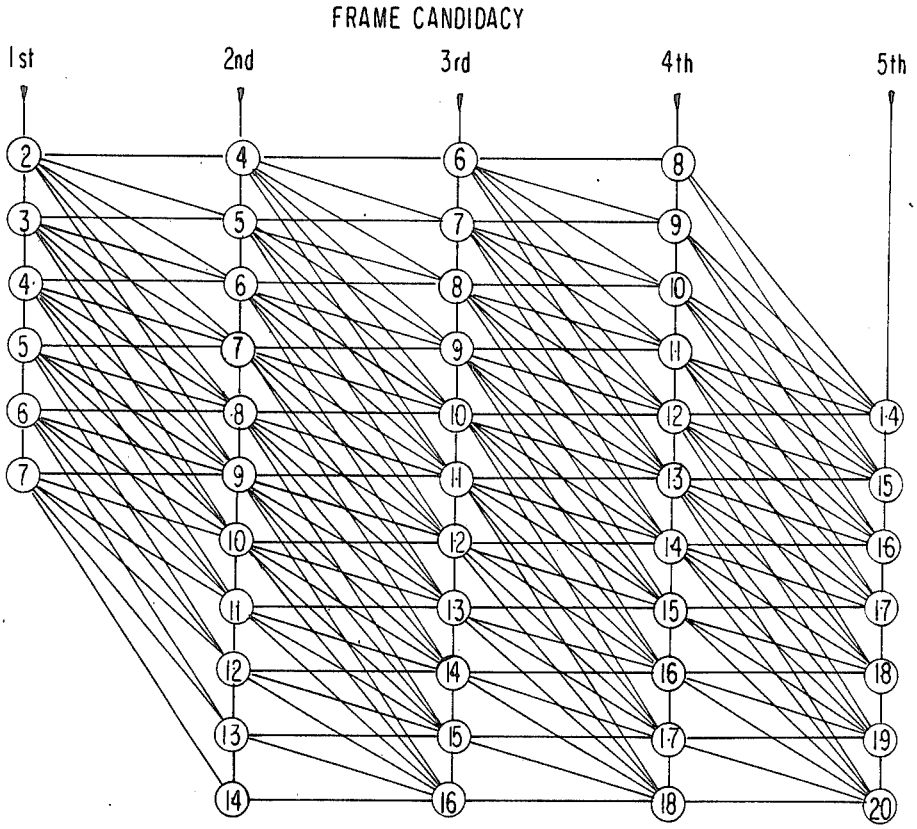
FIG. 2 is a diagram explaining procedures to determine the representative frames and frame intervals.

The optimum representative frames, the frame sections represented by the representative frames and the inclined sections present between the adjacent representation frame sections can be obtained efficiently through the dynamic programming technique as proposed in the report by Fushikida. Examples will be discussed in connection with the following:

FIG. 2 shows a flow of the processing for the most effective substitution of 20 frames analyzed continuously in time, as shown in FIG. 1B, (a basic frame period is set at 10 mSEC in the embodiment, therefore the time occupied by the 20 frames will be 200 mSEC) with 5 frames. The invention uses the above-mentioned trapezoidal approximation, the non-inclined section is made variable according to circumstances of the analyzed frames, and the inclined section is identified in one frame.

Now, let it be assumed that the 20 frames are identified sequentially as FR(1), FR(2), . . . FR(20), for the sake of convenience. In the embodiment, the frame FR(1) is set invariably in the inclined section, and the frames FR(2) and FR(20) are set invariably in the non-inclined section. In FIG. 2, numerals ②, ③, . . . ⑦ shown as 1st FRAME CANDIDACY indicate that the frame candidacies representing the first non-inclined section are frames FR(2), FR(3) , . . . FR(7).

For example, if the frame FR(2) represents the first non-inclined section, the frame FR(1) will be substituted by a linear interpolation parameter $\mathbb{P}_{P,2}$ of a parameter $\mathbb{P}_p$ representing the last non-inclined section of the past 20 frames and a parameter $\mathbb{P}_2$ of the frame FR(2). A distortion arising as a result of the substitution is expressed as G(1,2). Here, the first numeral "1" in parentheses denotes the first non-inclined section, and the second numeral "2" indicates that the frame representing the above-mentioned section is FR(2). G(1,2) can be obtained through the expression (4) based on the difference between a measured parameter $P_k^{(1)}$ of the frame FR(1) and an interpolation parameter $P_k^{(p,2)}$.

$$G(1,2) = \sum_{k=1}^{S} W_k(P_k^{(1)} - P_k^{(p,2)})^2 \quad (4)$$

Here, $P_k^{(1)}$ is a vector element of a parameter $\mathbb{P}_1=(P_1^{(1)}, P_2^{(1)}, \ldots, P_k^{(1)}, \ldots P_s^{(1)})$ of the frame FR(1), and $P_k^{(p,2)}$ is a vector element of a linear interpolation parameter $\mathbb{P}_{p,2}=(P_1^{(p,2)}, P_2^{(p,2)}, \ldots, P_2^{(p,2)}, \ldots, P_k^{(p,2)}, \ldots P_s^{(p,2)})$ of the parameters $\mathbb{P}_p$ and $\mathbb{P}_2$. Then, each element of $\mathbb{P}_{p,2}$ is calculated from $\mathbb{P}_p=(P_1^{(p)}, P_2^{(p)}, \ldots P_k^{(p)}, \ldots P_s^{(p)})$ and $_2=(P_1^{(2)}, P_2^{(2)}, \ldots, P_k^{(2)}, \ldots P_s^{(2)})$ according to the following expression (5):

$$P_k^{(p,2)}=\tfrac{1}{2}(P_k^{(P)}+P_k^{(2)} \quad (5)$$

$W_k$ in the expression (4) is a weighting coefficient.

Similarly, if FR(3) is a frame representing the first non-inclined section, the frame FR(1) is substituted by a linear interpolation parameter $\mathbb{P}_{p,3}$ between the parameter $\mathbb{P}_p$ and $\mathbb{P}_3$ of the frame FR(3) which is calculated likewise as the expression (5), and since the frame FR(2) is included in the non-inclined section represented by the frame FR(3), the parameter $\mathbb{P}_2$ is substituted by $\mathbb{P}_3$. A distortion arising as a result of the substitution is shown by the following expression (6), accordingly:

$$G(1,3) = \sum_{k=1}^{S} W_k(P_k^{(1)} - P_k^{(p,3)})^2 + \sum_{k=1}^{S} W_k(P_k^{(2)} - P_k^{(3)})^2 \quad (6)$$

Further, if the frame FR(7) is a frame representing the first non-inclined section, the frame FR(1) is substituted by a linear interpolation parameter $\mathbb{P}_{p,7}$ of the parameter $\mathbb{P}_p$ and the parameter $\mathbb{P}_7$ of the frame FR(7) which is calculated likewise as the expression (5), and since the frames FR(2), FR(3), FR(4), FR(5), FR(6) are included in the non-inclined section represented by the frame FR(7), parameters $\mathbb{P}_2$, $\mathbb{P}_3$, $\mathbb{P}_4$, $\mathbb{P}_5$, $\mathbb{P}_6$ are substituted by the parameter $\mathbb{P}_7$. A distortion G(1,7) arising as a result of the substitution is shown likewise by the following expression (7):

$$G(1,7) = \sum_{k=1}^{S} W_k(P_k^{(1)} - P_k^{(p,7)})^2 + \sum_{FR=2}^{6}\left(\sum_{k=1}^{S} W_k(P_k^{(FR)} - P_k^{(7)})^2\right) \quad (7)$$

In FIG. 2 numerals ④, ⑤, . . . , ⑭ shown as the 2nd FRAME CANDIDACY indicate that candidacies of the frames representing the second non-inclined section are FR(4), FR(5), . . . , FR(14).

For example, let it be assumed that FR(4) represents the second non-inclined section, then the frame to represent the first non-inclined section is FR(2) necessarily, and FR(3) is included in the non-inclined section. That the 2nd FRAME CANDIDACY ④ and the 1st FRAME CANDIDACY ② are connected through a straight line indicates the above-mentioned relation. If FR(4) is a frame to represent the second non-inclined section, then a distortion G(2,4) arising as a result of the frame substitution due to FR(4) having been selected can be obtained through the following expression (8) using G(1,2) given hereinabove.

$$G(2,4) = G(1,2) + D_{2,4} \quad (8)$$

where, $D_{2,4}$ is a distortion due to the substitution of the frames FR(2) to FR(4), that is, the substitution of a parameter $\mathbb{P}_3$ of the frame FR(3) by the linear interpolation parameter $\mathbb{P}_{2,4}$ of a parameter $\mathbb{P}_2$ of FR(2) and a parameter $\mathbb{P}_4$ of FR(4).

Next, assuming that the frame FR(5) represents the second non-inclined section, then the frames FR(2) and FR(3) are conceivable as frame candidacies to represent the first non-inclined section. Connection through a straight line between the second FRAME CANDIDACY ⑤ and the first FRAME CANDIDACIES ② and ③ represents the above-mentioned relation. When selecting the frame FR(4) as a frame candidacy representing the second non-inclined section, as the frame candidacy representing the first non-inclined section the frame having smaller distortion is selected of the frames FR(2) and FR(3). The distortion G(2,5) can be given by the following expression (9);

$$G(2,5) = \min\begin{cases} G(1,2) + D_{2,5} \\ G(1,3) + D_{3,5} \end{cases} \quad (9)$$

where, $D_{3,5}$ is a distortion determined likewise as $D_{2,4}$, and $D_{2,5}$ is the minimum distortion to arise as a result of the substitution of the frames FR(2) to FR(5). The minimum distortion refers to the smaller distortion of the distortions obtained by the frame substitution in which the inclined section is identified to FR(3) or FR(4), that is, it refers to a distortion given by the following expression (10):

$$D_{2,5} = \min\begin{cases} \sum_{k=1}^{S} W_k(P_k^{(3)} - P_k^{(2,5)})^2 + \sum_{k=1}^{S} W_k(P_k^{(4)} - P_k^{(5)})^2 \\ \sum_{k=1}^{S} W_k(P_k^{(4)} - P_k^{(2,5)})^2 + \sum_{k=1}^{S} W_k(P_k^{(3)} - P_k^{(2)})^2 \end{cases} \quad (10)$$

Here, the first term on the right side of expression (10) indicates a substitution distortion of the frame FR(3) or FR(4) included in the inclined section, and the second term on the right side indicates a distortion arising as a result of the frame FR(4) or FR(3) included in the non-inclined section being substituted by the frame FR(5) or FR(2). Then, if the frame candidacy representing the second non-inclined section is identified to FR(5) according to the expression (10), the frame representing the first non-inclined section is determined. Further, the section to be represented by the frame determined as above is also readily determined.

Similarly, if the frame FR(6) is identified to the frame candidacy to represent the second non-inclined section, a distortion G(2,6) is given by the following expression (11) as in the case of expression (9).

$$G(2,6) = \min\begin{cases} G(1,2) + D_{2,6} \\ G(1,3) + D_{3,6} \\ G(1,4) + D_{4,6} \end{cases} \quad (11)$$

$D_{2,6}$ is then given by the following expression (12) as minimum value of the distortion to arise when the frame candidacies to be substituted to the inclined section as in the case of expression (10) are identified to FR(3), FR(4), FR(5).

$$D_{2,6} = \min\begin{cases} \sum_{k=1}^{S} W_k(P_k^{(3)} - P_k^{(2,6)})^2 + \sum_{FR=4,5}^{S}\left(\sum_{k=1}^{S} W_k(P_k^{(FR)} - P_k^{(6)})^2)\right) \\ \sum_{k-1}^{S} W_k(P_k^{(4)} - P_k^{(2,6)})^2 + \sum_{k=1}^{S} W_k(P_k^{(3)} - P_k^{(2)})^2 + \sum_{k=1}^{S} W_k(P_k^{(5)} - P_k^{(6)})^2 \\ \sum_{k=1}^{S} W_k(P_k^{(5)} - P_k^{(2,6)})^2 + \sum_{FR=3,4}^{S}\left(\sum_{k=1}^{S} W_k(P_k^{(FR)} - P_k^{(2)})^2\right) \end{cases} \quad (12)$$

Here, the first term on the right side of the expression (12) indicates a substitution distortion of the frame FR(3), FR(4) or FR(5) included in the inclined section, and the second term on the right side indicates a distortion arising as a result of (1) FR(4), FR(5), (2) FR(3), FR(5), or (3) FR(3), FR(4) included in the non-inclined section being substituted by (1) FR(6), (2) FR(2) and FR(6), or (3) FR(4) respectively. $D_{3,6}$ and $D_{4,6}$ are also determined as in the case of expressions (10) and (4).

When the frame candidacy representing the second non-inclined section is identified to FR(6) according to the processes of calculation of $D_{3,6}$ and also of the expressions (11) and (12), the frame representing the first non-inclined section and the section represented by the frame to represent the first non-inclined section are determined simultaneously.

Similarly, when FR(7), FR(8), . . . , FR(14) are identified to the frame candidacies representing the second non-inclined section, distortions G(2,7), G(2,8), . . . , G(2,14) according to each frame substitution, frames representing the first non-inclined section, and the section represented by the frames representing the first non-inclined section are determined successively.

Furthermore, distortions G(3,6), G(3,7), . . . , G(3,16) according to each frame substitution by FR(6), FR(7), . . . , FR(16) shown in the 3rd FRAME CANDIDACY of FIG. 2, frames representing the corresponding second non-inclined section, and the section represented by the frames representing the second non-inclined section are determined successively.

Next, distortions G(5,14), G(5,15), . . . , G(5,20) corresponding to the frame candidacies FR(14), FR(15) . . . , FR(20) representing the fifth (last) non-inclined section shown in the 5th FRAME CANDIDACY through determination of the 4th FRAME CANDIDACY, frames representing the corresponding fourth non-inclined section, and the section represented by the frames representing the fourth non-inclined section are determined successively.

Lastly, an optimum frame is determined from among frame candidacies FR(14), FR(15), . . . , FR(20) representing the fifth non-inclined section according to the following expression (13):

$$G_{min} = \min \begin{cases} G(5,14) + \sum_{FR=15}^{20} \left( \sum_{k=1}^{S} W_k (P_k^{(FR)} - P_k^{(14)})^2 \right) \\ G(5,15) + \sum_{FR=16}^{20} \left( \sum_{k=1}^{S} W_k (P_k^{(FR)} - P_k^{(15)})^2 \right) \\ \cdot \\ \cdot \\ G(5,18) + \sum_{FR=19}^{20} \left( \sum_{k=1}^{S} W_k (P_k^{(FR)} - P_k^{(18)})^2 \right) \\ G(5,19) + \sum_{k=1}^{S} W_k (P_k^{(20)} - P_k^{(19)})^2 \\ G(5,20) \end{cases} \quad (13)$$

wherein, the second term on the right side of the expression (13) indicates a distortion arising as a result of the sections FR(15) to FR(20), FR(16) to FR(20) being substituted by the frame candidacies FR(14), FR(15) representing the fifth non-inclined section.

Frames representing the fifth, fourth, third, second, and first non-inclined sections are determined through the above processing, and section lengths represented by each representative frame are also determined. In other words, frames included in the inclined section are determined. Thus, a parameter signal $\mathbb{P}$ of the representative frames and a repeat bit signal giving a number M of the frames included in the representative section represented thereby are obtained.

It is noted here that the setting of FR(2) to FR(7) as the 1st FRAME CANDIDACY and FR(4) to FR(14) as the 2nd FRAME CANDIDACY is determined automatically by limiting the maximum frame interval, and frame candidacies different from FIG. 2 can easily be set by selecting the maximum frame interval optionally.

Now, construction of the vocoder according to one embodiment of this invention will be described with reference to FIG. 3. The parts forming the vocoder may be known vocoders parts such as those used in the LSP vocoder (disclosed, for example, in the report by Itakura et al.).

An analysis side 302 is constituted of a low-pass filter & A/D converter 303, a window processor 304, an LSP parameter analyzer 305, a second source analyzer 306, a DP processor 307, an LSP parameter memory 308, and a coder 309. A synthesis side 311 is constituted of a decoder 312, a pulse generator 313, a noise generator 314, A V-UV change-over switch 315, a sound source amplitude regulator 316, an LSP synthesis filter 317, a D/A converter & low-pass filter 318, and an interpolator 319.

A speech signal coming through an input terminal 301 has a voice band limited, for example, to 3.4 kHz and is sampled at 8 kHz and quantized by the low-pass filter & A/D converter 303. A sampled signal is supplied to the window processor 304. The window processor 304 stores temporarily a signal obtainable through multiplying the sampled signal by a predetermined window function and outputs the result to the LSP parameter analyzer 305 and the sound information analyzer 306 with 240 samples unitized to 1 block. The block is produced, for example, at every 10 mSEC. The LSP parameter analyzer 305 determines an LSP parameter vector from the speech signal supplied at every 10 mSEC through a known technique such as that described in the report by Itakura et al. identified hereinbefore.

The DP processor 307 handles a continuous I set (I being 20, for example) out of the sequence of LSP parameter vectors supplied from the LSP parameter analyzer 305 as one segment, obtains N pieces (N being 5, for example) of representative frames through operations of the above-mentioned expressions (4) to (13) and a repeat bit signal indicating the number M of frames present in the non-inclined section represented by the representative frames, and then outputs the result to the coder 309. Here, it is noted that a start frame of one segment begins at the inclined section and an end frame begins at the non-inclined section. Consequently, the LSP parameter vector of the N-th representative frame in one previous section to the present section becomes necessary for DP operation.

The LSP parameter memory 308 stores temporarily the LSP parameter vector of the N-th representative frame in the one previous section selected by the DP processor 307, and outputs the LSP parameter vector stored at the time of DP processing of the present section.

The coder 309 quantizes N pieces of LSP parameter vectors and a repeat number M supplied from the DP processor 307, and supplies the quantized signals to the synthesis side 311 through a transmission path 310 together with a sound source information parameter.

The sound source information analyzer 306 extracts pitch information, V-UV information, power information and the like from the voice signal supplied from the window processor 304 according to a known technique, and outputs to the coder 309.

The decoder 312 decodes a coded LSP parameter vector and the like and outputs pitch information of the sound source information to the pulse generator 313, V-UV information to the V-UV change-over switch 315 and power information to the sound source amplitude regulator 316. The decoder 312 further outputs an LSP parameter vector to the known LSP synthesis filter 317 through the interpolator 319 according to the repeat number M of the section represented by the LSP parameter vector and also outputs an LSP parameter vector interpolated by the interpolator 319 to the LSP synthesis filter 317 according to a fixed inclined section length.

The pulse generator 313 supplies a sequence of pitch pulses based on the pitch information to the V-UV change-over switch 315. The noise generator generates and outputs a white noise to the switch 315. The switch 315 supplies an output of the pulse generator 313 to the sound source amplitude regulator 316 when the V-UV information indicates a voiced sound and an output of the noise generator 314 thereto when an unvoiced sound is indicated. The sound source amplitude regulator 316 regulates the amplitude of a signal supplied from the switch 315 in accordance with to the power information and outputs the result to the LSP synthesis filter 317 as a sound source signal of the LSP synthesis filter.

One example of an LSP synthesis filter 317, is shown by FIG. 9.2 and FIG. 9.3 and described in Paragraph 9.2 of "Line Spectrum Pair", "BASIS OF SOUND INFORMATION", by Shuzo Saito and Kazuo Nakata, published by OHM-SHA ON Nov. 30, 1981.

The D/A converter & low-pass filter 318 converts the thus obtained digital speech signal into a continuous (analogue) speech waveform, removes any unnecessary frequency components, and outputs a synthesized speech to an output terminal 320.

Next, another embodiment applied to a pattern matching vocoder using the LSP parameter will be described. As described above, in the pattern matching vocoder using the LSP parameter as spectrum information of the voice, the spectral sensitivity is used as a weighting coefficient $W_k$ to obtain the spectral distance shown in the expression (2). However, it has been confirmed experimentally that spectral sensitivity varies according to LSP frequency interval. Therefore, to the use the weighting coefficient specified as a function only of spectral sensitivity is to invite a deterioration of the synthesized voice.

Now, therefore, in this embodiment, a more practical pattern matching is secured by specifying the weighting coefficient as a function not only for LSP spectral sensitivity but also for LSP frequency interval, thus improving the quality of the synthesized speech. It has been confirmed that the weighting coefficient is substantially influenced by the LSP frequency interval only when the frequency interval is short. Therefore, the LSP frequency interval of an analysis frame will have to be checked beforehand for determining the weighting coefficient, and thus a frequency interval sensitivity will be considered only where the frequency interval below a constant value is included.

Figure 3:
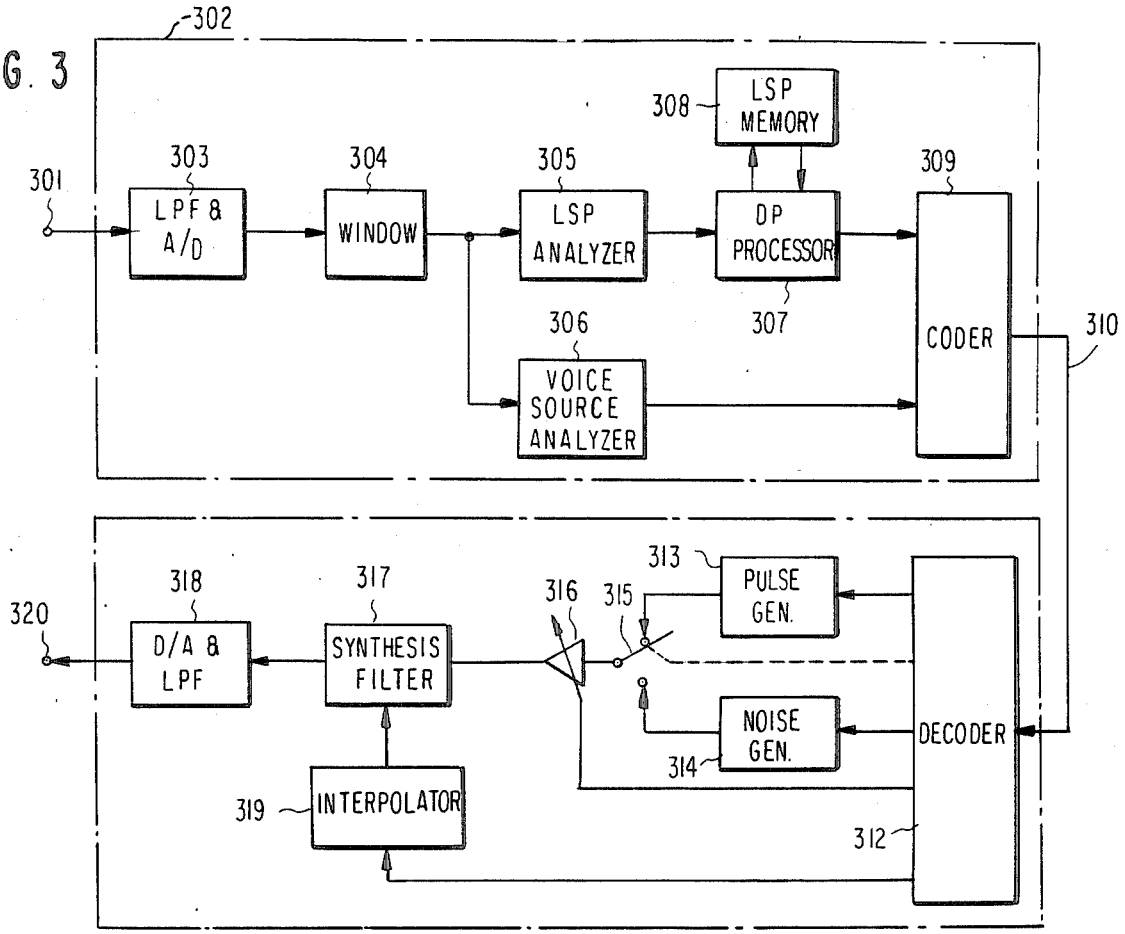
FIG. 3 is a block diagram of a one embodiment of the present invention.
Figure 4A:
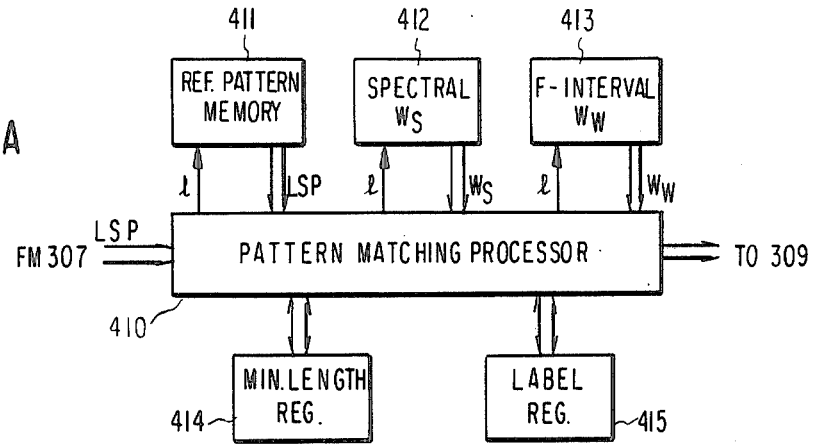
FIG. 4A and FIG. 4B are partial block diagrams of the vocoder according to another embodiment of the present invention.
Figure 4B:
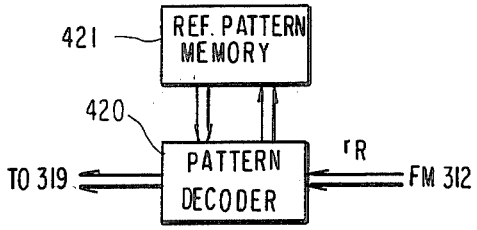

FIG. 4A and FIG. 4B are block diagrams of an analysis side and a synthesis side representing an embodiment of this invention. In the drawings, like members are identified by the same reference numerals. What is different from FIG. 3 is that the analysis side has a pattern matching portion for outputting a reference pattern label selected through pattern matching by means of the LSP parameter obtained on the DP processor 307, comprising a pattern matching processor 410, a reference pattern memory 411, a spectral sensitivity memory 412, a frequency interval memory 413, a minimum length resistor 414, a label register 415, and that the synthesis side has a pattern decoder 420 receiving a label decoded on the decoder 312 and outputting the LSP parameter which constitutes the reference pattern specified in the label by a reference pattern memory 421 storing the same contents as the reference pattern memory 411 to the interpolator 319.

A detailed description will be given of the pattern matching division on the analysis side with reference to FIG. 4A. The reference pattern memory 411 stores a distribution content of a standard LSP coefficent of the speech obtainable through LSP analysis of a speech data prepared beforehand. The operation is normally called "clustering" and is particularly described as "segmentation" in the report by Raj Reddy and Robert Watkins. The operation will be summarized as follows:

First, preprocessing, removing a silent section, removing an unnecessary near-by frame, and classifying by voice sound, unvoiced sound and silence, for a prepared speech data is carried out through LPC analysis or the like.

In this case, a frame period is given, for example, at 10 mSEC, and a tag code for voiced sound, unvoiced sound, silence, or transition sound between voiced sound and unvoiced sound is given at every frame. Next, the silent frame is removed, the remaining frames are separated into voiced sound and unvoiced sound, and the transition sound will be included in either or both of voiced sound and unvoiced sound. Furthermore, the frame close in time and smaller in spectral distance is removed, thus the number of necessary samples is curtailed, and then these are classified at every spectral distances set beforehand according to a reference pattern selecting technique known hitherto, registered and stored as reference patterns.

For the reference pattern technique mentioned above, it is assumed that a space U of ten-dimensional LSP coefficient consists, for example, of N pieces of patterns in the case of this embodiment, the above-mentioned spectral distance is measured for each of the N-piece patterns, that of having a distance below the spectral distance value $\theta dB^2$ set beforehand is obtained for all the N-piece patterns, and a pattern $P_L$ having a maximum pattern number $M_i$ ($i=1, 2, \ldots, N$) is determined. The pattern $P_L$ with the spectral distance coming below the value $\theta dB^2$ set beforehand is removed from the space U of ten-dimensional coefficient, then $P_L$ is registered as a reference pattern, and such operation is carried out repeatedly until there is no pattern included in the space U, thus registering it as a reference pattern. The reference pattern thus obtained normally runs several thousand kinds and is stored in the memory 411 with address (label) given thereon.

A frequency sensitivity $W_s$ and a frequency interval sensitivity $W_w$ of the LSP parameter read out of the reference pattern memory 411 which must be subjected to pattern matching are stored in the spectral sensitivity memory 412 and the frequency interval sensitivity memory 413. Both the sensitivities $W_s$ and $W_w$ will be obtainable experimentally beforehand.

A readout of data from the reference pattern memory 411, the spectral sensitivity memory 412 and the frequency interval sensitivity memory 413 is carried out as follows:

For example, a vector $\mathbb{P}^{(r)}$ of the r-th reference pattern of two thousand reference patterns expressed in S-dimensional vector will be given:

$$\mathbb{P}_r^{(r)}=(P_1^{(r)}, P_2^{(r)}, \ldots, P_l^{(r)}, \ldots, P_s^{(r)})$$

To read out the l-th member $p^{(r)}$ which constitutes the r-th reference pattern vector from the reference pattern memory 411, signals indicating r and l will be selected as a readout signal. On the other hand, from supplying l signal to the spectral sensitivity memory 412 and the frequency interval memory 413, the sensitivities $W_s$, $W_w$ determined on the frequency corresponding to the l-th LSP vector member are outputted from the memories.

The pattern matching is a processing for determining a spectral distance between an input pattern from the DP processor 307 and a reference pattern read out sequentially from the reference pattern memory 411 and for selecting the reference pattern indicating the minimum distance. The processing is carried out by use of the pattern matching processor 410, the minimum length register 414, and the label register 415. A calculation of the spectral distance is carried out according to the following expression (14) in this embodiment despite being based on the expression (2) hitherto.

$$D_{I,J} = D_{i,j} + a \cdot \sum_{l=1}^{p-1} W_{wl} \cdot ABS\left(\frac{b}{P_{l+1}^{(r)} - P_l^{(r)}} - 1.0\right) \quad (14)$$

where $D_{i,j}$ indicates the distance $D_{i,j} = \sum_{k=1}^{N} W_k(P_k^{(i)} - P_k^{(j)})$, expressed by expression (2), a denotes a weighting coefficient to determine which to use preferably a frequency spectral sensitivity or a frequency interval sensitivity for obtaining a better result on selecting the reference pattern, and an optimum value is determined experimentally. $W_{wl}$ represents a frequency interval sensitivity relating to vector member $P_l^{(r)}$, ABS( ) represents an absolute value in the parentheses, and b denotes a constant corresponding to the period threshold value for which the frequency interval sensitivity must be taken into consideration, which is obtainable experimentally.

Now, the minimum length register 414 and the label register are initialized at maximum value and "O", respectively, according to the frame period signal. LSP parameter vector $\mathbb{P}_R$ of the representative frame from the DP processor 307 is supplied to the processor 410. An address signal r for reading out the reference patterns sequentially and a vector member specifying signal l are supplied to the reference pattern memory 411 from the processor 410. A member $\mathbb{P}_l^{(r)}$ which constitutes the r-th reference pattern spectrum $\mathbb{P}^{(r)}$ is read out sequentially from the memory 411 according to this readout signal. All the reference patterns are read out by changing r from 1 to a prepared reference pattern number and further changing l from 1 to S for each r. Then, the vector member specifying signal l is supplied to the spectral sensitivity memory 412 and the frequency interval memory 413, therefore the sensitivity constants $W_s$ and $W_w$ according to the specified member $P_l^{(r)}$ are read out.

Thus, the distance of the expression (14) is calculated first by changing l from 1 to S for the first reference pattern, the calculated distance and the content stored in the minimum length register 414 are compared with each other, and where the calculated distance is smaller, the content stored in the register 414 is substituted by the calculated distance, which is so stored. On the other hand, a label (r for example) of the r-th reference pattern is written in the label register.

The label $r_R$ stored in the label register 415 after the above processing is carried out on all the reference patterns is such reference pattern label as is most analogous to the pattern consisting of LSP parameter included in the representative frame supplied to the processor 410, and the label signal $r_R$ is supplied to the coder 309. The repeat bit signal M outputted from the DP processor 307 is also supplied to the coder 309. The above processing is carried out on the pattern constituting the representative frame in the representative frame section of the variable length frame.

The above various signals transmitted from the analysis side are decoded on the decoder 312 of the synthesis side, and those other than the label signal $r_R$ are inputted to each member as in the case of FIG. 3. The same reference pattern as that on the analysis side which is specified by $r_R$ out of the reference pattern memory 421 is read out and decoded by the pattern decoder 420 as shown in FIG. 4B. Thus the decoded pattern is supplied to the interpolator 319 as a representative frame vector $\mathbb{P}^{(rR)}$. Construction and operation of the other entities are same as FIG. 3.

Figure 5:
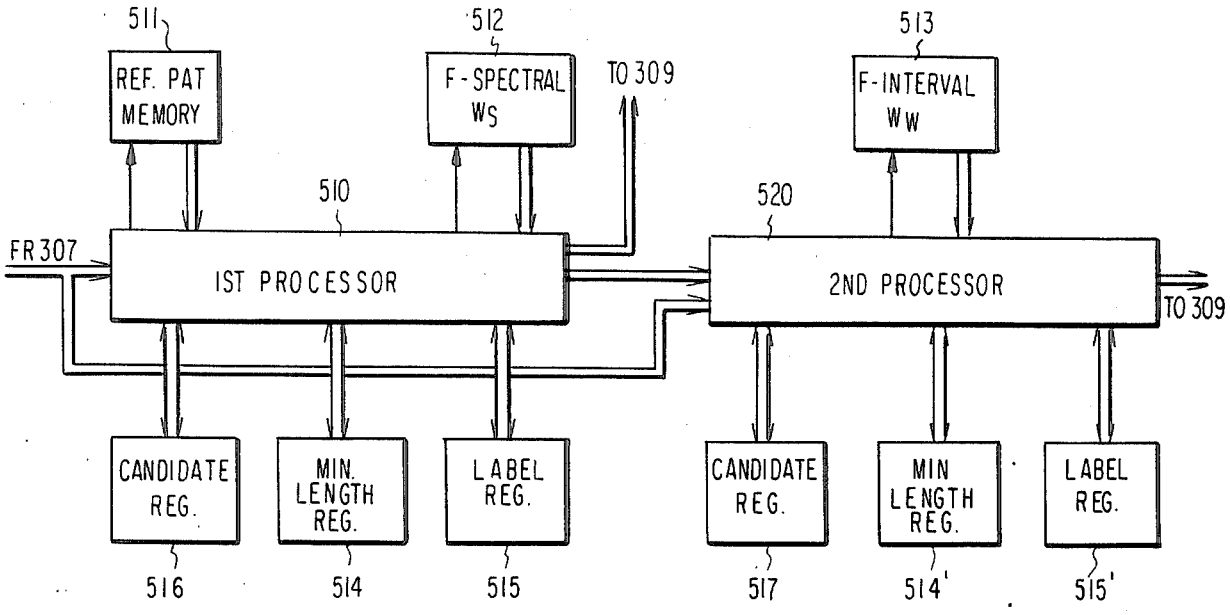
FIGS. 5 and 6 are partial block diagrams of the vocoder according to an embodiment of the present invention.

The above embodiment uses the expression (14) in which the ferquency period spectral sensitivity $W_w$ is taken into consideration for all the reference patterns to obtain the spectral distance. However, as mentioned above, since $W_w$ scarcely exerts an influence on the spectral distance when the frequency interval is small, whether or not the frequency has a period below a predetermined frequency interval will be decided on each reference pattern when the spectral distance is calculated, and if not, then the conventional spectral distance calculating expression (2) may be used, but if yes, the expression (14) can be used. In this case, a predetermined number of reference patterns are selected from the smaller one of the distances obtained through the expression (2) as a pattern candidacy, and the spectral distance is calculated according to the expresssion (14) only for the selected pattern candidacy. This method is advantageous in a phase of operation quantity. The embodiment will be then described as follows:

In this embodiment the construction given in FIG. 4A is replaced by FIG. 5. In the drawing, a reference pattern memory 511, a frequency spectral sensitivity memory 512, a frequency interval spectral sensitivity memory 513, minimum length registers 514, 514', and label registers 515, 515' have a similar function to the members shown in FIG. 4, however, what is different is that the registers 514 and 515 store the above predetermined number of distances and labels. Pattern candidacy registers 516, 517 store the above predetermined number of pattern candidacies.

A first processor 510 decides whether or not the interval below a predetermined value (obtainable experimentally, at for example, 0.025 (rad)) is included in the sequence of LSP frequencies of a vector constituting the reference pattern read out of the reference pattern memory 511. If not included, then the first processor 510 carries out a spectral distance operation according to the expression (2) using the frequency spectral sensitivity only and supplies the label signal $r_R$ of the reference pattern which is most similar to the coder 309 through a technique similar to FIG. 4. As described, parenthesises in the expression (14) is represented by the sensitivity $W_w$ determined on frequency interval of the first and second LSP parameters.

On the other hand, if included, a predetermined number (2 for example) of pattern candidacies are selected preliminarily in the first processor 510 from among the prepared reference patterns. In other words, the predetermined number of reference patterns smaller in that order are taken up for pattern candidacy by use of distance information obtained according to the expression (2). Spectral distances thus selected are denoted by $D_1$, $D_2, \ldots, D_i$. If $D_1 << D_2$, the frequency interval spectral sensitivity is not particularly to be used, therefore the reference pattern whereby the distance $D_1$ is obtained is supplied to the coder 309. If not $D_1 << D_2$, then $R_j$ defined as:

$$R_j = D_j / D_1 \ (j=2, 3, \ldots, i)$$

leaving the reference pattern coming within a threshold value (can be set experimentally and set at 1.2 to 3.0 normally) only as a pattern candidacy and makes the pattern candidate memory 517 store the information.

A second processor 520 has a function almost the same as the pattern matching processor in FIG. 4: a pattern matching is performed between LSP information from the DP processor 307 and that of the pattern candidacy read out of the pattern candidate memory 517, and the pattern having minimum length is taken out of the pattern candidacies as a pattern for the above-mentioned representative frame. The label $r_R$ indicating the pattern having minimum length is supplied to the coder 309. The spectral distance calculation is carried out here according to the expression (14) in which the frequency interval spectral sensitivity $W_w$ is taken into consideration.

Figure 6:
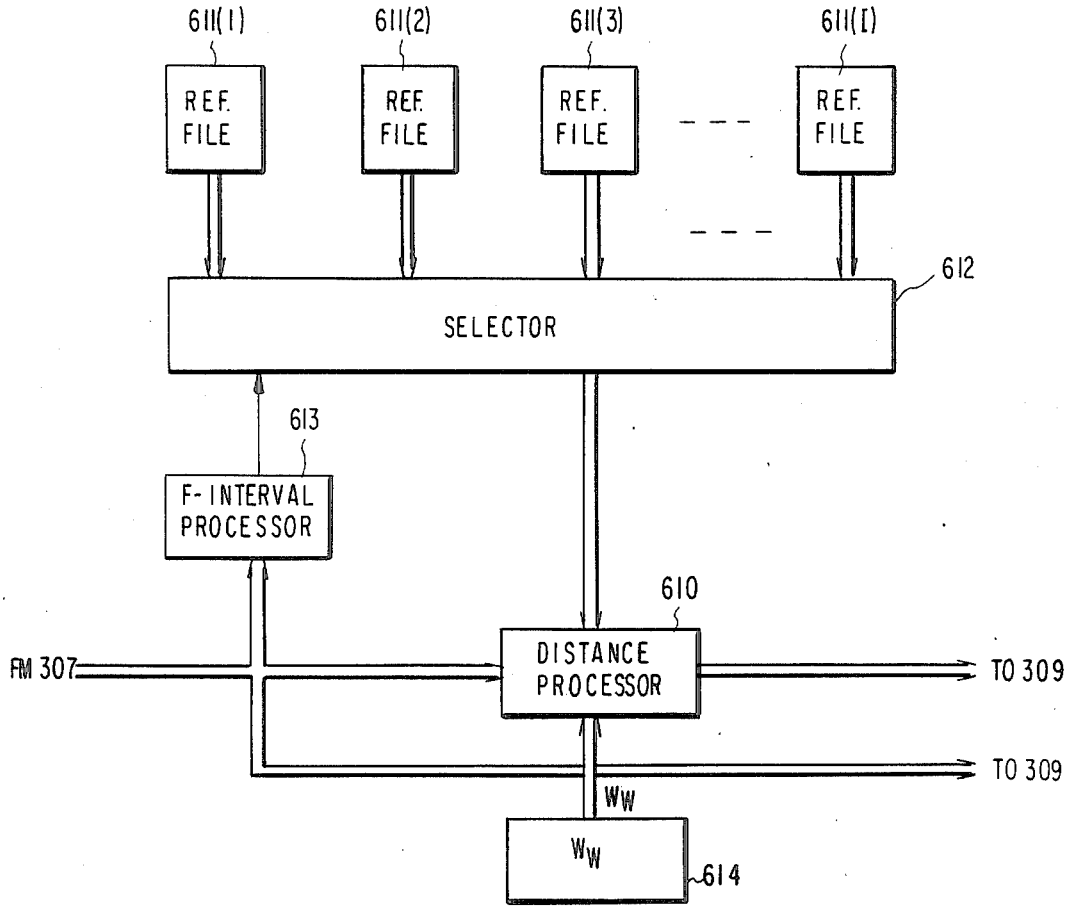

The construction of the anaylsis side in another embodiment of this invention is given in FIG. 6 and is intended for determining the reference patterns effectively The reference pattern memory in the analysis side of the embodiment shown in FIG. 4A is according to the FIG. 6 embodiment composed of a plurality of reference pattern files classified according to the LSP frequency interval of the speech data, and operates by selecting first the reference pattern file with the frequency interval of the LSP parameter obtainable through subjecting the input speech signal to LSP analysis working as a standard, determining the reference pattern by measuring the spectral distance between LSP frequency stored in the reference pattern file and LSP frequency obtained from the input speech signal, providing a means for transmitting a designation code data of the reference pattern file thus obtained and a designation code data of the reference pattern from the analysis side to the synthesis side.

In FIG. 6, reference pattern files 611(1), 611(2), 611(3), . . . , (611(I) are those of having each a frequency interval of a plurality of LSP information set beforehand according to the speech data.

LSP information supplied from the DP processor 307 measures LSP frequency interval which is set beforehand on an LSP period instrument 613, or an interval between $\omega_1$ and $\omega_2$ of 10-dimensional LSP frequencies $\omega_1, \omega_2, \ldots \omega_{10}$ particularly in this embodiment, and sends it to a reference pattern selector 612.

The reference pattern selector 612 reads contents stored in the reference pattern files 611(1) to 611(I), determines the reference pattern file having the most approximate LSP frequency interval, and sends a reference pattern file designation code data which designates a number of the reference pattern file to the coder 309.

The reference pattern selector 612 then sends the contents stored in the determined reference pattern file to a spectral distance instrument 610. The instrument 610 carries out a pattern matching through measuring a spectral distance to the LSP information of the input speech signal supplied from the DP processor 307 according to an arithmetic operation in which the frequency spectral sensitivity in the expression (2) is substituted by the frequency interval spectral sensitivity, selects the most approximate reference pattern number included in the determined reference pattern file, and then sends a reference pattern designation code data which designates the reference pattern to the coder 309. In a spectral distance operation in the spectral distance instrument 610, the frequency spectral sensitivity stored in the frequency spectral sensitivity memory 614 is utilized as a weighing coefficient at the time of operation in the expression (2).

Both the data of reference pattern file designation code and reference pattern designation code which are transmitted from the analysis side to the synthesis side through the coder 309 are utilized on the synthesis side together with the sound source information and the repeat bit data, thus reproducing the input speech signal. The synthesis side (not illustrated) has the reference pattern memory 421 shown in FIG. 4B replaced by the reference pattern files 611(1) to 611(K) shown in FIG. 6 in constitution, the reference pattern is reproduced and decoded as supplying both the data of reference pattern file designation code and reference pattern designation code to the decoder 312, and the synthesis processing can be carried out otherwise exactly in the contents described with reference to FIG. 4B.

In LSP type pattern matching vocoder, this embodiment of the present invention is characterized fundamentally in that LSP frequency interval spectral sensitivity is utilized as a weighting coefficient in the spectral distance measurement in addition to LSP frequency spectral sensitivity utilized hitherto, and thus the input speech signal can be synthesized conscientiously in case a spectral distance between LSP information of the reference pattern and LSP information obtainable through analyzing the input speech signal is measured to a matching measure; other variants are also conceivable in many ways.

For example, LSP information obtained by the LSP analyzer 18 is computed through a high degree equation process at the analysis side in each embodiment described above, however, it can be carried out by a zero-point search process well known together with the high degree equation process, and the LSP information is analyzed and extracted at every variable length frames, but the variable length frame can be made as a fixed length frame as occasion demands.

What is claimed is:

1. A variable frame length vocoder comprising: means for obtaining a feature vector from an output speech signal at every given frame; means for storing the feature vectors in a given section having a predetermined number of frames; means for approximating a change in said feature vectors in said given section with a given number of flat sections indicating the period of time with little or no change in the feature vectors, and inclined sections connecting said neighboring flat sections with inclined lines and indicating period of time with abrupt transitions in the feature vectors, said flat section length being variable, said inclined section length being constant, said inclined line representing the change of the feature vectors; means for outputting the feature vector of a given frame in each flat section as a representative vector of said flat section; means for outputting the number of frames present in said flat section as a repeat signal; and, on a synthesis side, means for producing the feature vector in each of said inclined sections by interpolating between the representative vectors of the flat sections present on both sides of said inclined section.

2. The variable frame length vocoder according to claim 1, including said flat sections and their representative vectors through a dynamic programming process carried out so that the summed distortion between a feature vector change expressed by said flat section and inclined section and a feature vector change of actual input speed is minimized.

3. The variable frame length vocoder according to claim 1, wherein said feature vector is a LSP parameter vector.

4. The variable frame length vocoder according to claim 1, further comprising, on the synthesis side, a synthesis filter driven by said representative vector and said repeat signal.

5. The variable frame length vocoder according to claim 3, further comprising a memory storing LSP information obtained for each of the given length frames for speech data prepared beforehand as a reference pattern, a pattern matching means for calculating a distance between LSP information of said representative vector and LSP information of said reference pattern to output a label signal indicating the reference pattern having minimum distance.

6. The variable frame length vocoder according to claim 5, wherein distance calculation in said pattern matching means is carried out by means of a weighting coefficient dependent on frequency of said LSP information.

7. The variable frame length vocoder according to claim 5, wherein the similarity calculation in said calculating means is carried out by means of a predetermined weighting coefficient dependent on frequency interval data of said LSP information.

8. The variable frame length vocoder according to claim 6, wherein the similarity calculation in said calculating means is carried out by means of a predetermined weighting coefficient dependent on frequency and frequency interval data of said LSP information.

9. The variable frame length vocoder according to claim 5, further comprising, on the synthesis side, means for receiving said label signal, and means for outputting the reference pattern designated by the label.

10. The variable frame length vocoder according to claim 8, wherein said pattern matching means includes:

a first pattern matching means for carrying out the pattern matching by means of the weighting coefficient dependent on frequency of said LSP information, means for deciding whether or not the frequency interval of said LSP information exceeds a predetermined theshold value, means for outputting the label signal indicating the reference pattern obtained through said first pattern matching means when the frequency interval is equal to or exceeds said threshold value, and outputting a predetermined number of reference patterns as candidate patterns in such a manner that the reference pattern having the minimum distance and those being the distance close to the minimum distance are successively outputted in that order when the frequency interval comes below said threshold value, and a second pattern matching means for carrying out pattern matching with the weighting coefficient dependent on LSP frequency interval by means of distance information, to output the label signal indicating the pattern having the minimum distance among said candidate patterns.

11. The variable frame length vocoder according to claim 3, further comprising:

a memory for storing a plurality of reference patterns having a given frequency interval, means for obtaining the frequency interval data from said obtained LSP information, a reference pattern selecting means for selecting a given reference pattern from said plurality of reference patterns in response to the obtained frequency interval, and a pattern matching means for carrying out pattern matching with the weighting coefficient dependent on the frequency interval data from said input LSP information and LSP information of said selected reference pattern to output the label signal indicating the obtained reference pattern having the minimum distance.

* * * * *

UNITED STATES PATENT AND TRADEMARK OFFICE

CERTIFICATE OF CORRECTION

PATENT NO. : 4,701,955

DATED : October 20, 1987

INVENTOR(S) : TAGUCHI

It is certified that error appears in the above-identified patent and that said Letters Patent is hereby corrected as shown below:

COLUMN 1, LINE 53 Delete first instance of "change".

COLUMN 3, LINE 34 Delete "providing" insert --producing--.

COLUMN 6, LINE 43 Delete "..., $p_2^{(p,2)}$,„ (second occurrence)

COLUMN 6, LINE 46 After "and" insert --P--.

COLUMN 8, LINE 58 Delete "FR(4)" insert --FR(2)--.

COLUMN 11, LINE 60 Delete "resistor", insert --register--.

COLUMN 13, LINE 3 Delete "processing" insert --process--.

COLUMN 15, LINE 26 After "effectively" insert --.--

COLUMN 18, LINE 2 Delete "pattern matching" insert --calculating--

COLUMN 18, LINE 5 After "frequency" insert --interval--

COLUMN 18, LINE 8 After "interval" insert --data--

COLUMN 18, LINE 12 After "interval" insert --data--

COLUMN 18, LINE 16 Delete "distance" insert --similarity--

UNITED STATES PATENT AND TRADEMARK OFFICE

CERTIFICATE OF CORRECTION

PATENT NO. : 4,701,955

DATED : October 20, 1987

INVENTOR(S) : TAGUCHI

It is certified that error appears in the above-identified patent and that said Letters Patent is hereby corrected as shown below:

COLUMN 18, LINE 17 Delete "minimum" insert --maximum--

COLUMN 18, LINE 18 Delete "distance" insert --similarity--

COLUMN 18, LINE 19 After "interval" insert --data--

COLUMN 18, LINE 25 Delete "minimum distance" insert --maximum similarity--

Signed and Sealed this

Twenty-fifth Day of October, 1988

*Attest:*

*Attesting Officer*

DONALD J. QUIGG

*Commissioner of Patents and Trademarks*